US005085624A

United States Patent [19]

Felix

[11] Patent Number: 5,085,624

[45] Date of Patent: Feb. 4, 1992

[54] APPARATUS AND PROCESS FOR THE ZIGZAGGED FOLDING AND STACKING OF A WEB OF MATERIAL

[75] Inventor: Willi Felix, Strengelbach, Switzerland

[73] Assignee: Jos. Hunkeler, Ltd., Wikon, Switzerland

[21] Appl. No.: 425,422

[22] Filed: Oct. 23, 1989

[30] Foreign Application Priority Data

Oct. 24, 1988 [DE] Fed. Rep. of Germany ..... 3836214

[51] Int. Cl.[5] ..... B65H 45/20; B65H 45/101

[52] U.S. Cl. ..... 493/413; 493/410; 493/415; 493/423

[58] Field of Search ..... 493/410, 411, 412, 413, 493/414, 415, 423

[56] References Cited

U.S. PATENT DOCUMENTS

| | | | |
|---|---|---|---|
| 3,972,519 | 8/1976 | Melzer | 493/410 |
| 4,573,670 | 3/1986 | Felix | 493/413 |
| 4,670,001 | 6/1987 | Campbell et al. | 493/413 |
| 4,681,003 | 7/1987 | Bernath | 83/80 |

FOREIGN PATENT DOCUMENTS 1141610 12/1962 Fed. Rep. of Germany ..... 493/411

*Primary Examiner*—William E. Terrell

*Attorney, Agent, or Firm*—Davis Hoxie Faithfull & Hapgood

[57] ABSTRACT

Apparatus for the zigzagged folding and stacking of a web of material fed from below and, further, for conveying away stacks as they are finished. The apparatus comprises a reciprocating carriage containing deflection members that define a reciprocating passage through which web feeds from below and two supporting belts associated with the deflection members. The belts have upper stack-supporting surfaces that alternately lengthen and shorten as the deflection members reciprocate to form a stack. Compensating arrangements accommodate changes in length of those upper surfaces. To convey away finished stacks, one belt is endless. A releasable holding element clamps the endless belt to the carriage during stack formation but releases the belt for conveying away stacks. A drive unit is provided to drive the endless belt, when unclamped, for conveying away stacks.

23 Claims, 6 Drawing Sheets

Figure 1:
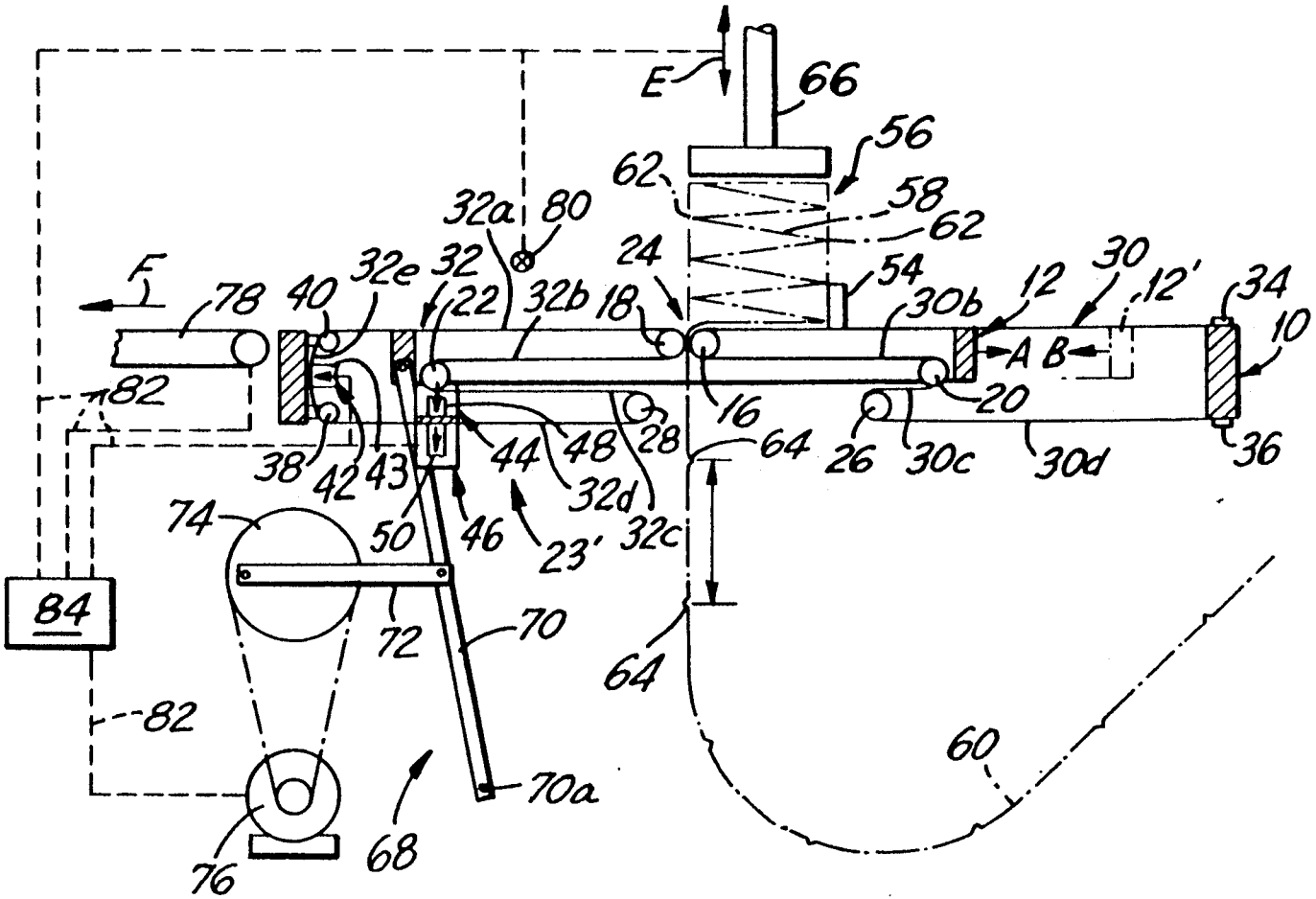

APPARATUS AND PROCESS FOR THE ZIGZAGGED FOLDING AND STACKING OF A WEB OF MATERIAL

The present invention relates to an apparatus for the zigzagged folding and stacking of a web of material fed from below.

Zigzag folding and stacking apparatus is known, for example, from German Offenlegungsschrift 3,344,260 and U.S. Pat. No. 4,573,670, corresponding thereto. This has a carriage, which can be moved back and forth between two end positions and on which two deflection members or rolls, bounding a passage opening for a web of material fed from below, are mounted freely rotatably. It has two supporting elements in the form of belts, the carrying sides of which are led from a fixed fastening point each to the deflection rolls concerned. Each supporting element is deflected by the assigned deflection roll and then led in the form of an S over a first deflection roller, mounted rotatably on the carriage, and subsequently over a second, fixed, freely rotatably mounted deflection roller to a further fixed fastening point. Upon the reciprocating movement of the carriage, the change in length the section of each supporting element between the latter two deflection rollers compensates for the enforced lengthening or shortening of the carrying side concerned. The web of material fed from below is folded in the form of a zigzag and stacked into a stack resting on the supporting elements and building up from the bottom. As soon as the stack has reached the desired height, the web of material is severed in the stack manually along a fold line and the upper part of the stack is lifted off. In the meantime, the folding and stacking of the fed web of material continues. For the subsequent further processing in a high-speed processing machine, such as for example a tearing or cutting apparatus, the folded webs of material of the individual stacks are again joined to one another. This takes place by sticking together of the respectively lowermost material web section of the one stack with the uppermost material web section of the next stack, as described in more detail for example in European laid-open patent application 0,274,737. In this way, a long, continuous web of material is obtained, in which the material web section first fed to the folding and stacking device is again the first fed to the processing machine. It is of course obvious that the severing of the web of material in the respectively formed stack and the later joining of the lowermost and uppermost material web sections of successively formed stacks necessitates a considerable amount of time and work.

So the present invention is based on the object of providing zigzag folding and stacking apparatus which makes it possible to fold fed webs of material into stacks joined to one another in a time-saving and labor-saving way and largely avoiding manual work.

This object is achieved by the apparatus and process of this invention.

BRIEF SUMMARY OF THE INVENTION

As stated above, this invention concerns apparatus for the zigzagged folding and stacking of a web of material, having two deflection members which are arranged on a carriage, bound a gap-shaped passage opening for the web of material fed from below and can be moved back and forth together with the carriage underneath the stack to be formed, essentially in a direction at right angles to the passage opening, between two end positions which lie apart by at least the distance between two neighboring fold point; said apparatus having two supporting elements which are in the form of belts, form with their carrying sides a support for the stacks and are led around the deflection members to length compensation arrangements, which are designed to compensate for the enforced lengthening of the one carrying side and shortening of the other carrying side, and which elements are held in place during stacking by means of fixed holding elements.

According to this invention one supporting element is of an endless design and is led over a deflection arrangement provided fixedly at the end of its carrying side remote from the deflection member. The holding element associated with the endless supporting element is designed for the releasable holding in place of the supporting element. Conveying drive means are provided in order to drive the endless supporting element, when released by the holding element, for conveying away the finished stacks in the direction going from the deflection members to the deflection arrangement.

The supporting element of endless design is held in place during the folding and stacking of the web of material by means of a fixed holding element. It consequently serves during the folding and stacking to put the web of material on the stack to be formed. As soon as a finished stack is formed, the holding element releases the supporting element, so that the latter serves to convey the finished stack away, driven in a circulating manner by the conveying drive means. Upon conveying away, the web of material is drawn after the finished stack by the conveying distance of the stack. Upon renewed activation of the holding element and disconnection of the conveying drive means, the formation of a new stack can be commenced, without the web of material having to be separated. Since the switching from folding and stacking to conveying away and back again can be performed very quickly, the processing of the web of material is interrupted for an extremely short time. The arriving continuous web of material is thus folded automatically and piled up into stacks, which are joined to one another via the web of material without any adhesion of material web sections being necessary.

In the case of a particularly preferred embodiment at least one clamp is provided to connect the endless supporting element to the carriage such that translation of the carriage conveys away a finished stack. In this manner, the movement of the carriage for the driving of the endless supporting element is used for the conveying away of the finished stacks. Consequently, a separate drive for the supporting element is not necessary.

In the case of a first further preferred embodiment, on the carriage there are provided two clamping arrangements, which can be activated alternately when the finished stacks are conveyed away. With the first clamping arrangement activated, the carrying side of the endless supporting element is firmly connected to the carriage, while, with the second clamping arrangement activated, the conveying side of the supporting element is moved in the opposite direction in relation to the direction of movement of the carriage. The finished stacks are consequently conveyed away independently of the direction of movement of the carriage In a further embodiment, the clamping device can be brought to bear on the deflection arrangement or the second deflection roller and the clamping arrangement can be brought to bear on the deflection member concerned or the first deflection roller, in order to clamp the endless supporting element fixedly in place or to the carriage In this case, the supporting element is connected in a non-slipping manner to the deflection arrangement or the deflection roller and to the deflection member or the first deflection roller. The action of the clamping device and of the clamping arrangement on the supporting element consequently takes place indirectly.

A preferred process for operating the apparatus of the first further preferred embodiment described above includes the steps of clamping the endless supporting element in place by means of the holding element during formation of a stack, during which time the two clamping arrangements are released. Then, for conveying away a finished stack; the holding element is released and the first and second clamping arrangements are successively engaged one at a time so that the stack moves away as the carriage translates in both directions A and B. The holding element and clamping arrangements are then reset for formation of the next stack.

Figure 6:
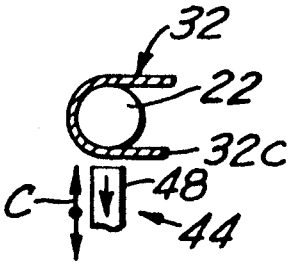
Figure 7:
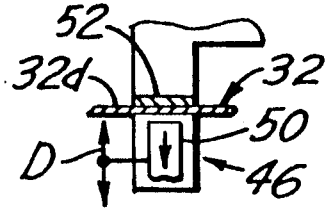

The invention is now described in more detail with reference to an exemplary embodiment Represented purely diagrammatically in the drawing:

FIGS. 1 to 5 show an embodiment of an apparatus according to the invention in side view and partially in section in various phases of the stack formation, FIGS. 6 and 7 show in enlarged representation the two clamping arrangements arranged on the carriage of the apparatus according to FIGS. 1 to 5 and FIG. 8 shows a further embodiment of the apparatus according to the invention in side view and partially in section.

In FIGS. 1 to 5, the same reference symbols are used for the same parts. However, they are only indicated in FIGS. 2 to 5 to the extent necessary for an understanding of the figure and of the operating principle of the apparatus.

Figure 2:
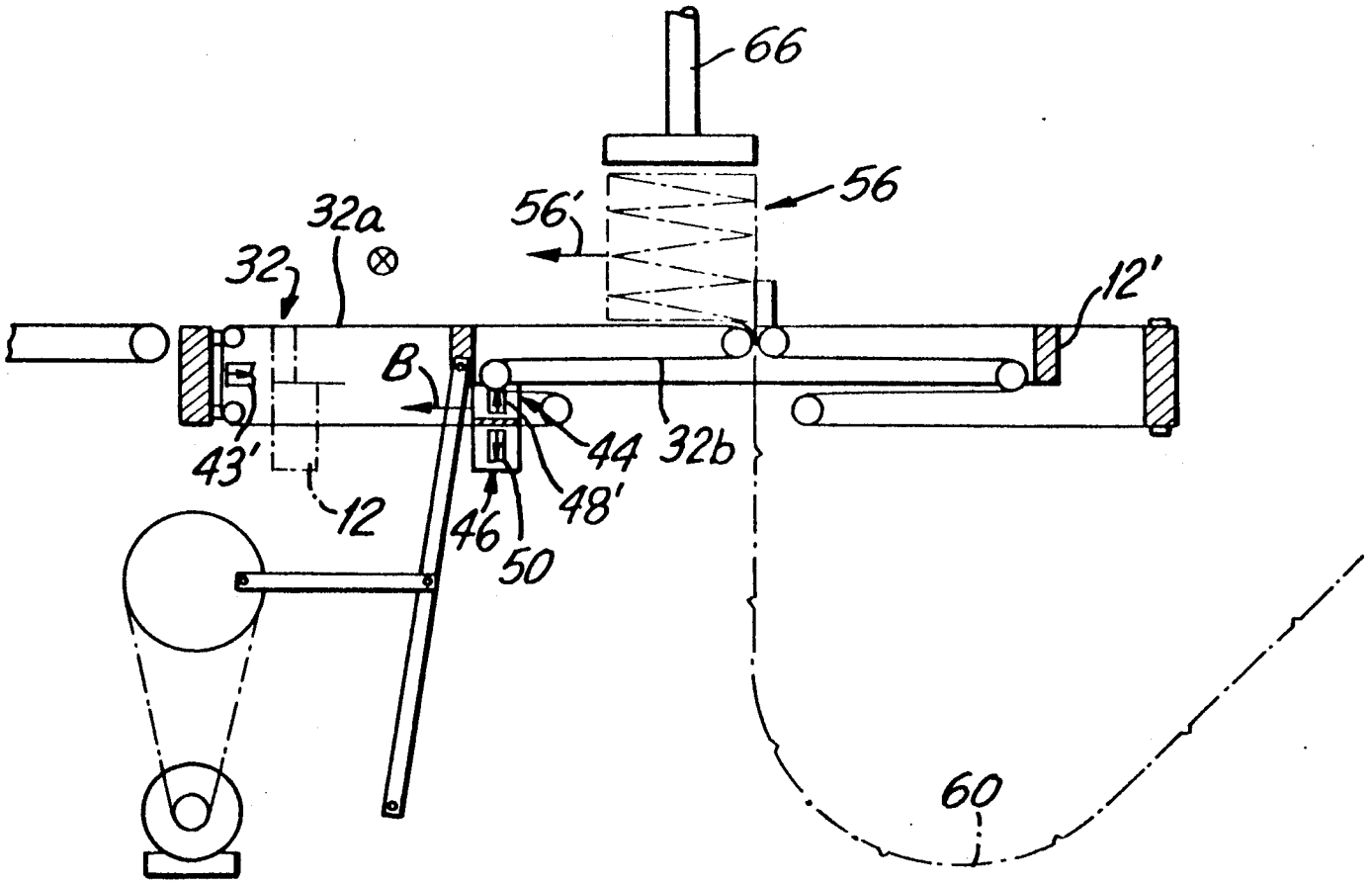
Figure 3:
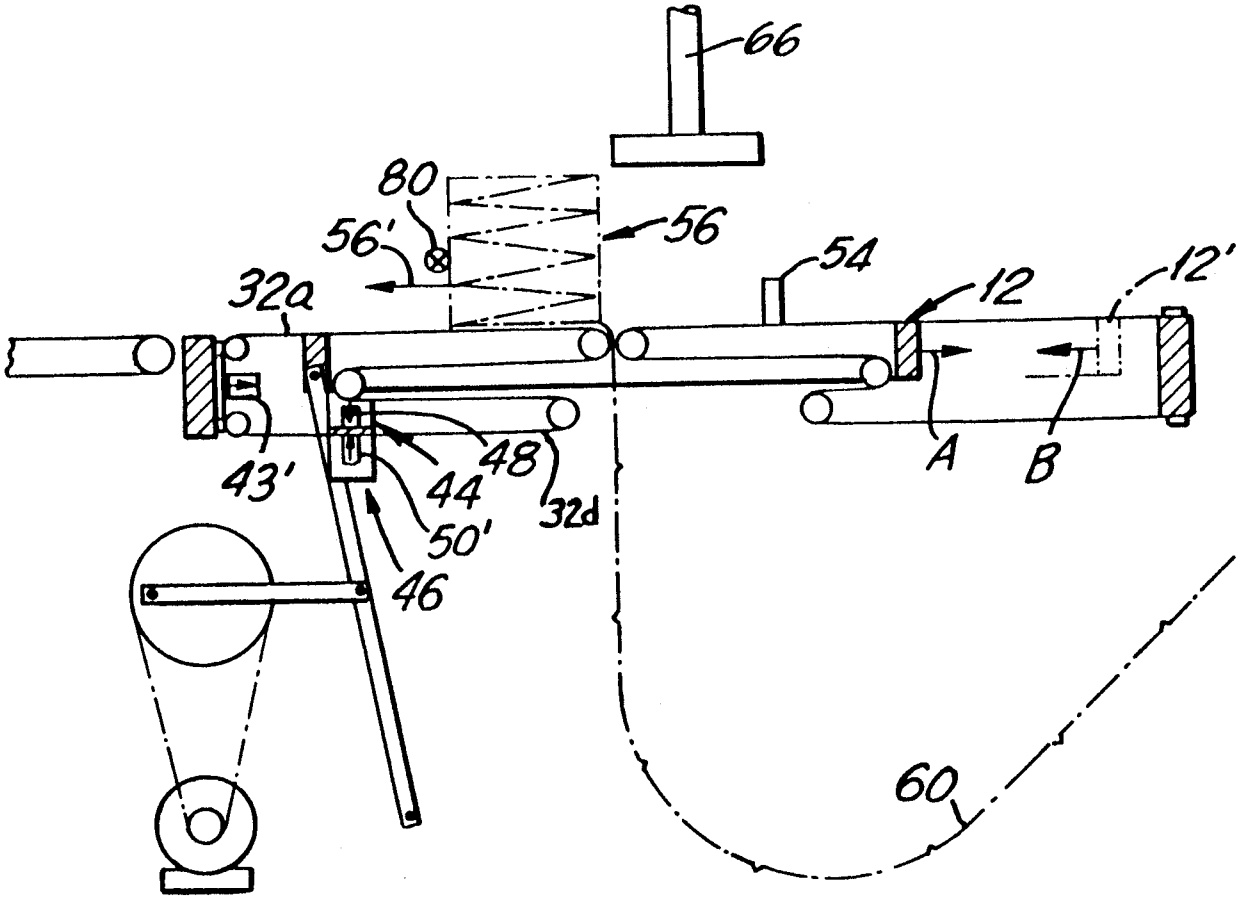
Figure 4:
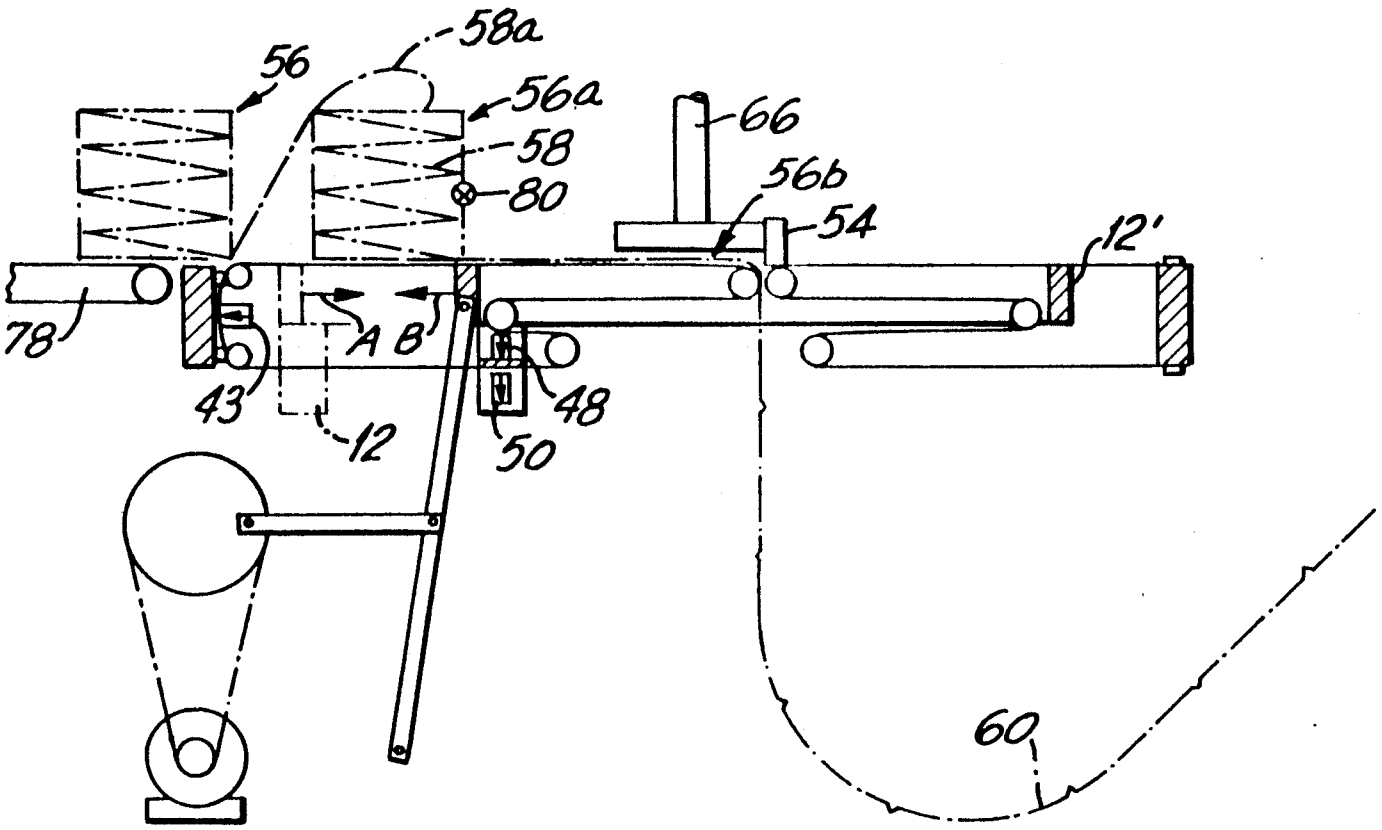
Figure 5:
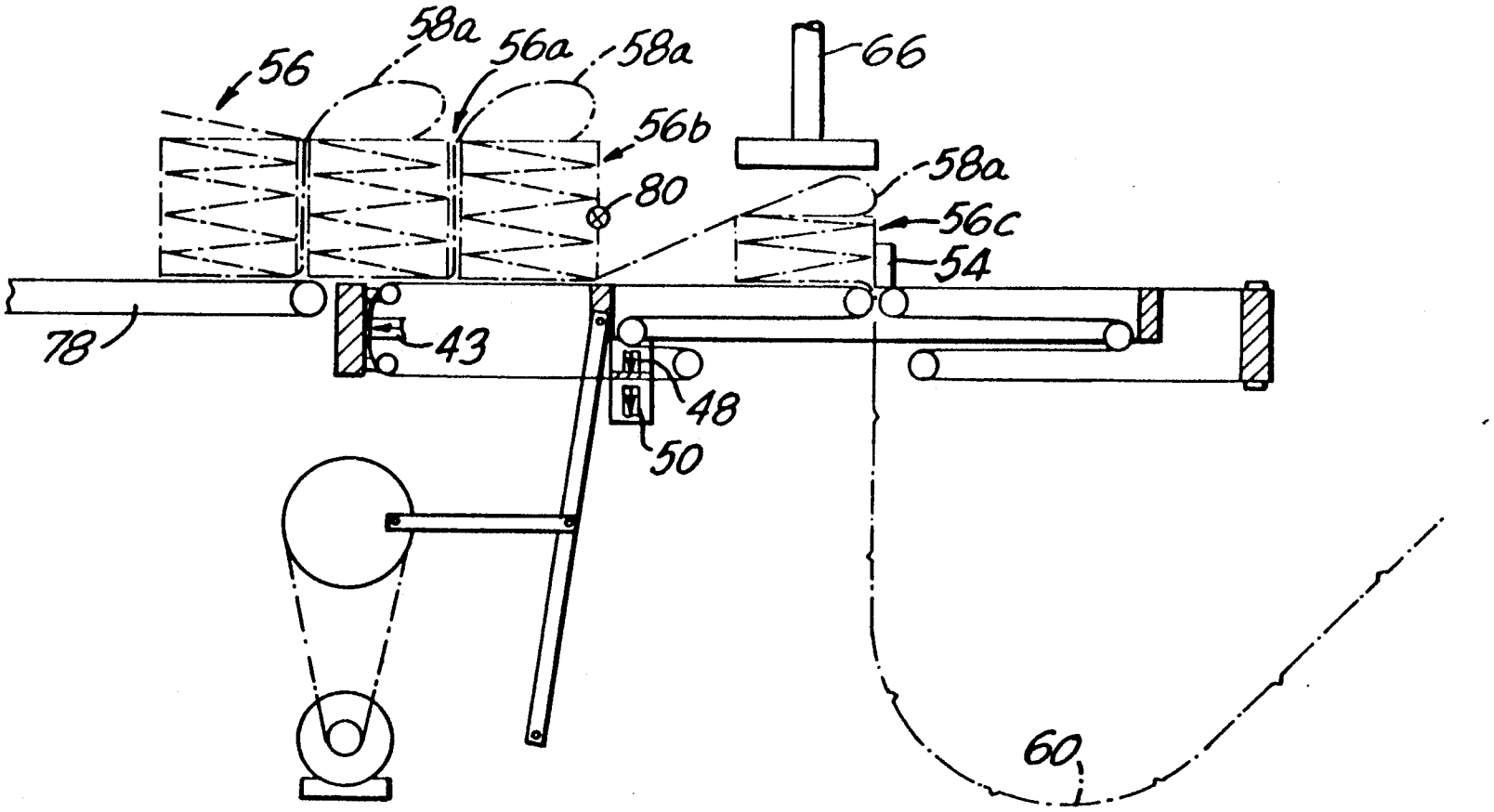

The apparatus shown in FIGS. 1 and 5 has a rack 10, which is only partially represented in the figures. Displaceably guided in this rack 10 is a carriage 12, which can be displaced in reciprocating translational movement in the direction of the arrows A and B. In FIGS. 1 and 3, the carriage 12 is shown in its left-hand end position, while the right-hand end position is indicated by broken lines and denoted by 12'. In FIGS. 2, 4 and 5, the carriage 12 is shown in its right-hand end position 12', while in FIG. 4 the left-hand end position is indicated by broken lines. The carriage 12 has a frame 14 (FIG. 8), on which two deflection rolls 16, 18 are mounted freely rotatably in the central area. In the front and rear region of the carriage 12, seen in the direction of movement A of the carriage 12, two deflection rollers 20, 22 of length compensation arrangements 23, 23' are mounted freely rotatably in the frame 14. The axes of rotation of the two deflection rolls 16, 18 and deflection rollers 20, 22 mounted in the carriage frame 14 run parallel to one another and at right angles to the direction of movement A, B of the carriage 12. The mutually opposite deflection rolls 16, 18 establish between themselves a passage opening 24 which runs essentially at right angles to the direction of movement A, B of the carriage 12. Underneath the deflection rolls 16, 1 and deflection rollers 20, 22 mounted on the carriage 12 there are arranged two further deflection rollers 26, 28 of the length compensation arrangements 23, 23', the axes of rotation of which run parallel to the axes of the deflection rolls 16, 18 and deflection rollers 20, 22 but, in contrast to the latter, are freely rotatably mounted fixedly in the rack 10.

A flexible belt 30 and 32, respectively, is led in the form of an S over these deflection rolls and deflection rollers 16, 20, 26 and 18, 22, 28, respectively. Instead of a single belt 30, 32, a plurality of adjacently arranged belts may also be provided, which are led in the same way as the belt 30 or 32. The belt 30 is of a finite length and fixed at its ends to the rack 10 at the fastening points denoted by 34 and 36. The belt 32 is of an endless design and is additionally led around a further deflection arrangement, two rolls 38, 40 rotatably mounted on the rack or frame 10. A first section 30*a* and 32*a*, respectively, of the belts 30, 32 runs from the one fastening point 34 or roll 40 in the direction of movement A, B of the carriage 12 above the latter to the deflection rolls 16 and 18, respectively. A second belt section 30*b* and 32*b*, respectively, which retains its position during the carriage displacement, runs approximately parallel to the first belt section 30*a* and 32*a*, respectively, from the deflection roll 16, 18 to the first deflection roller 20, 22. The subsequent belt section 30*c* and 32*c*, respectively, runs from the deflection roller 20 or 22 to the fixed deflection roller 26 or 28. The belt sections 30*d* and 32*d*, respectively, lie between the deflection rollers 26 or 28 and the second fastening point 36 or roll 38. These belt sections 30*d* and 32*d* like sections 30*b*, 32*b* do not change their length during the carriage movement. The belt sections 30*c*, 30*d* and 32*c*, 32*d* likewise run essentially parallel to the first belt section 30*a* and 32*a*, respectively. The section of the endless belt 32 lying between the two rolls 38 and 40 is denoted by 32*e*. In the region between the two rolls 38, 40 there is provided a symbolically represented holding element or fixed clamping device 42, the clamping member 43 of which can be transferred from a clamping or hold position, shown in FIGS. 1, 4 and 5, in which it clamps the belt section 32*e* between itself and the rack 10, into a rest position, shown in FIGS. 2 and 3 and denoted by 43', and back again.

If the arrow shown in the clamping device 42 points toward the belt section 32*e*, the clamping member 43 is in the clamping position, if on the other hand the arrow points away from the belt section 32*e*, the clamping member 43 is in the rest position 43'.

Two clamping arrangements 44 and 46, respectively, are fastened on the carriage frame 14 in the area of the deflection roller 22. The first clamping arrangement 44 is represented in FIG. 6 and the second clamping arrangement 46 is represented in FIG. 7, enlarged in each case. Each of the two clamping arrangements 44, 46 has a clamping element 48, 50, which can be transferred in the direction of the double-headed arrows C and D, from a rest position, shown in FIGS. 6 and 7 (as well as FIGS. 1, 4 and 5) into a clamping position, in contact with the belt 32 and shown by 48' and 50', respectively, as is represented in FIGS. 2 and 3, respectively. If the arrow shown in the clamping element 48, 50 is pointing away from the belt 32, the clamping element 48, 50 is in the rest position. If, on the other hand, the corresponding arrow is pointing toward the belt 32, the clamping elements 48, 50 are transferred into their clamping positions 48', 50'. In the clamping position 48', the clamping element 48 clamps the belt section 32*c* between itself and the first deflection roller 22, which has the result that the belt 32 stops in relation to the carriage 12. In the clamping position 50', the clamping element 50 clamps the belt section 32*d* between itself and a stop member 52, likewise fastened on the carriage frame 14. This has the result that, when the carriage 12 moves in arrow direction A, the first belt section 32*a* moves in the direction of the arrow B.

Arranged above the carriage 12 is a stop 54 for a stack respectively to be formed 56, 56*a*, 56*b*, 56*c*. On the side of the stop 54 opposite in relation to the respective stack 56, 56*a*, 56*b*, 56*c*, a further stop (not shown) may be provided, which must, however, be designed in such a way that it can be brought out of the area of the stack 56, 56*a*, 56*b*, 56*c*. However, this stop 54 and, if applicable, the further stop are not absolutely necessary, since the carriage movement does not cause any displacement of the stacks 56, 56*a*, 56*b*, 56*c* during their formation. Each stack 56, 56*a*, 56*b*, 56*c* is formed by sections 58, lying one on top of the other, of an endless web of material 60, which may be, for example, a web of paper, as shown in FIG. 1. This web of material 60 is folded at the fold points 62. These fold points 62 are fixed by perforations 64, which are arranged at regular intervals a (FIG. 8) and run at right angles to the longitudinal extent of the web of material 60. The web of material 60 is led from below through the passage opening 24 onto the upper side of the belts 30 and 32, respectively. A non-return device (not shown) for the web of material 60 may be provided underneath the passage opening 24.

Above the stack to be formed 56, 56*a*, 56*b*, 56*c* there is shown a pressing element 66, which can be lowered in arrow direction E onto the stack 56, 56*a*, 56*b*, 56*c* or lifted off the same.

The back and forth movement of the carriage 12 is produced by a crank gear 68. This has a rocking lever 70, which is swivel-mounted at one end about an axis 70*a* and acts at the other end on the carriage frame 14. This rocking lever 70 is connected in an articulated manner to a drive lever 72, which is attached at the other end eccentrically to a drive wheel 74. The latter is driven in a rotating manner by a motor 76. The rotational movement of the drive wheel 74 has as a consequence, in a known way, a rocking back and forth of the rocking lever 70 and thus a corresponding back and forth movement of the carriage 12.

The rack 10 is adjoined in the region of the rolls 38, 40 by a removal conveying device 78 for conveying away the finished stacks 56 in arrow direction F. A light barrier, which is provided above the belt 32 and is arranged offset to the left by twice the distance a (FIG. 1) in relation to the stop 54, is denoted by 80.

The generally known drive arrangements (not shown) for the clamping device 42, the clamping arrangements 44, 46, the pressing element 66 and the conveying device 78, as well as the motor 76 and the light barrier 80, are connected via lines 82, indicated by dot-dashed lines, to a control 84. The latter controls the entire apparatus during the folding and stacking of the web of material 60 as well as during the conveying away of the finished stacks 56, 56*a*, 56*b*, 56*c*, resting on the carrying side 32*a* or on the removal conveying device 78.

In FIG. 1, the first stack to be formed 56 is represented during the folding and stacking operation and in FIG. 2 the finished stack 56 is represented. In FIG. 3, the position of the stack 56 after the first stroke of the carriage 12 in arrow direction B for conveying the stack 56 away is indicated. In FIG. 4, the second finished stack 56*a* is in the position in which formation of the third stack 56*b* is commenced; the stack 56*a* is shown partially pushed toward the first stack 56. According to FIG. 5, the three finished stacks 56, 56*a*, 56*b* are shown pushed against one another, the stack 56*b* being away from the stop 54 by twice the distance a (FIG. 1); the fourth stack 56*c* is not yet finished.

Figure 8:
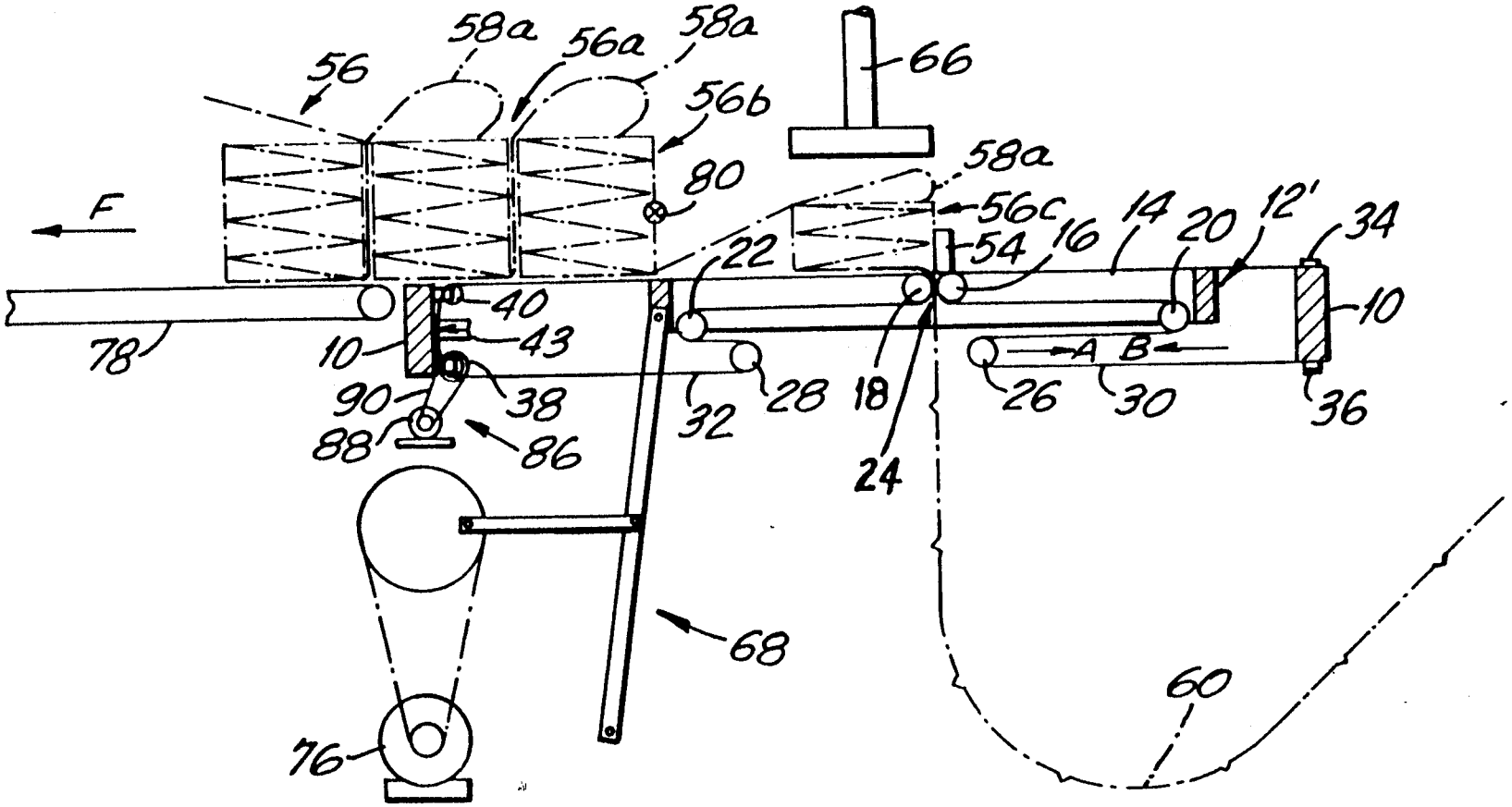

FIG. 8 shows a further embodiment of the apparatus according to the invention for zigzagged folding and stacking of the web of material 60 in a representation similar to FIG. 5. The apparatuses shown in these two figures are of an identical design, with the exception that in the apparatus according to FIG. 8 the clamping arrangements shown in FIGS. 1 to 5, denoted by the reference numerals 44 and 46, with the clamping elements 48 and 50, are replaced by a conveying drive 86. The reference symbols in this FIG. 8 refer to precisely the same parts as in the case of the apparatus according to FIGS. 1 to 5. Therefore, these are only described to the extent necessary for an understanding of FIG. 8. The conveying drive 86 has a conveying motor 88, which is connected via a chain drive 90 to the roll 38. The endless belt 32 is led in a non-slipping manner around the roll 38, runs through between the clamping member 43 and the rack 10 to the roll 40, from there in a known way to the deflection roll 18 and in the form of an S around the deflection rollers 22 and 28 back to the roll 38.

The other belt 30 is fastened to the rack 10 at one end at the fastening point 34, runs to the deflection roll 16 and from there in the form of an S around the two deflection rollers 20 and 26 to the fastening point 36, where it is fixed at the other end to the rack 10. The two deflection rolls 16 and 18 as well as the two deflection rollers 20 and 22 are mounted freely rotatably on the carriage frame 14 of the carriage 12, which can be moved back and forth in arrow direction A and B by means of the motor 76 and crank gear 68. Three finished stacks 56, 56*a*, 56*b* rest on the removal conveying device 78 and the belt 32, the stack denoted by 56*c* being still to be finished by zigzagged folding of the web of material 60 fed from below through the passage opening 24. The bulges of those sections of the web of material 60 which join two succeeding stacks 56, 56*a*, 56*b*, 56*c* to each other are denoted by 58*a*. The pressing element 66 is shown lifted off the stack 56*c*.

The apparatus described further above according to FIGS. 1 to 7 operates as follows:

For the folding and stacking of the fed web of material 60, the clamping member 43 of the clamping device 42 is transferred into the clamping position and the clamping elements 48, 50 of the clamping arrangements 44, 46 are in their rest positions, as is indicated in FIG. 1 by the corresponding arrows. With carriage 12 in the left-hand end position, the beginning of the web of material 60 fed from below through the passage opening 24 is brought into contact with the stop 54 and the pressing element 66 is lowered, so that the first section 58 of the web of material 60 is clamped between the belt 30 and the pressing element 60. Upon the movement of the carriage 12 in arrow direction A, the part of the web of material 60 in contact with the belt 30 in the region of the deflection roll 16 lifts off the said web and is bulged. Upon further movement, this bulge is clamped between the first section 58 of the web of material 60 and the belt 32, which leads to a fold formation at the first perforation 64. As soon as the carriage 12 has reached the right-hand end position 12', a folding of the web of material takes place in the opposite sense at the beginning of the return movement of the carriage 12 in arrow direction B. This folding operation is described in detail in German Offenlegungsschrift 3,344,260. The stroke of the carriage 12 in the back and forth movement underneath the stack 56 is slightly greater than the distance a between two succeeding fold points 62 or perforations 64. During the folding operation, the pressing element 66 is raised according to the stack height, until it is lifted off the stack 56 after a given number of folding operations and transferred in arrow direction E into the upper end position. The enforced change in the length of the section 30*a*, 32*a* in the stacking operation is added to by the opposite change in length of the belt section 30*c*, 32*c*.

As soon as the finished stack 56 has reached the necessary height or a given number of sections 58 of the web of material 60 for the stack 56 have been folded, the carriage 12 is transferred into the right-hand end position 12', as is represented in FIG. 2. In this position of the carriage 12, the clamping member 43 of the clamping device 42 is transferred into the rest position denoted by 43' and the belt 32 is clamped by means of the clamping arrangement 44. As a result, the carrying section 32*a* and second section 32*b* of the belt 32 are held in place in relation to the carriage 12 Upon the then following movement of the carriage 12 in arrow direction B, the finished stack 56, resting on the first belt section 32*a*, is taken along, as is indicated by the arrow 56', until the carriage 12 is in its left-hand end position, shown in dot-dashed lines. Then, as is represented in FIG. 3, the clamping element 48 is transferred into its rest position and the clamping element 50 of the clamping arrangement 46 is transferred into the clamping position 50'. Upon the then following movement of the carriage 12 in arrow direction A from its left-hand end position to the right-hand end position 12', the first belt section 32*a* moves by virtue of the entrainment of the belt section 32*d* counter to the arrow direction A, so that the finished stack 56 is pushed further in arrow direction 56', to be precise until the stack 56 clears the light barrier 80, analogously to how this is indicated in FIG. 4 by the finished stack 56*a* represented on the right. Since the stroke of the carriage 12 is slightly greater than the distance a and the light barrier 80 is away from the stop 54 by twice the distance a, this is the case shortly before the carriage 12 has reached its right-hand end position 12'. Then the clamping element 50 is also transferred into its rest position and the clamping member 43 of the clamping device 42 is transferred into the clamping position, as a result of which the stack 56 is held fixedly during further movement of the carriage 12. Upon the displacement of the stack 56 in arrow direction 56', the said stack has drawn the web of material 60 after it, so that a perforation 64 comes into contact with the stop 54 in the folding operation now commencing again.

As is represented in FIG. 4 for the formation of the third stack 56*b*, the pressing element 66 is in each case lowered for the formation of a new stack 56, with carriage 12 in the right-hand end position 12'. Upon the then following back and forth movements of the carriage 12 in arrow direction B and A, respectively, a further stack 56*a* is formed in an analogous way to that described further above. Since the pressing element 66 is lifted off the stack to be formed, 56*a*, after a few folding steps, the section 58 lying on top of this stack 56*a* is released, so that the difference in height can be balanced out, this leading to a bulge 56*a* of the two uppermost sections 58.

As soon as the second stack 56*a* is finished, in an analogous way to that described further above for the first stack 56 and represented in FIGS. 2 and 3, the stack 56*a* is displaced to the left by twice the distance a, as represented in FIG. 4. The first formed stack 56 is also thereby pushed onto the removal conveying device 78, as a result of which, however, the distance between the two stacks 56 and 56*a* is reduced as a consequence of the stationary removal conveying device 78.

The formation of a further stack 56*b* then takes place in an analogous way and, after completion, stack 56*b* is in turn displaced to the left by twice the distance a. The second stack 56*a* is thereby pushed up against the first stack 56, and subsequently the pushing of the last-formed stack 56*b* against the stack 56*a* takes place. This is indicated in FIG. 5. The removal conveying device 78 is controlled by means of the control 84 in such a way that the stacks 56, 56*a* . . . are conveyed away up against one another. As is indicated in FIG. 5, the formation of a further stack 56*c*, which is subsequently also conveyed in the direction toward the removal conveying device 78, then takes place.

The web of material 60 is consequently processed into a multiplicity of stacks 56, 56*a*, 56*b*, 56*c* . . . , without having to be separated. The finished stacks 56, 56*a* . . . can be fed by means of the removal conveying device 78 to a station further processing them continuously, for example a tearing or cutting unit or an enveloping machine.

For the processing of webs of material 60 with a different distance a between successive perforations 64, the stroke of the carriage 12 is adapted in a known way, and the light barrier 80 is displaced in the direction toward the stop 54 if the distance a is smaller and in the opposite direction if the distance a is greater, so that the distance between the stop 54 and the light barrier 80 is twice the distance a. Different stack heights can be achieved by fewer or more strokes of the carriage 12 being executed. It is also possible for a finished-formed stack 56, 56*a* . . . to be conveyed by more than twice the distance a in the direction toward the removal conveying device 78. The only condition which has to be fulfilled is that, in the next folding, a fold point 62 must take place at a perforation 64. This means that the distance between the stop 54 and the last-formed finished stack 56, 56*a*, 56*b* is an integral multiple of the distance a.

In order to make possible a precise positioning of the finished stack 56, 56*a* . . . , a troublefree pushing together of the stacks 56, 56*a* . . . and a smooth switching of the clamping device 42 or clamping arrangements 44, 46, the speed of the motor 76 is in each case reduced toward the end of the formation of a finished stack 56, 56*a* . . . until the first folds have been made by the new stack.

For the zigzagged folding and stacking of the web of material 60, the embodiment of the apparatus shown in FIG. 8 operates just like the apparatus according to FIGS. 1 to 5. The clamping member 43 is in its clamping position and holds the belt 32 in place in relation to the rack 10. So as soon as a finished stack 56 has reached the necessary height or a given number of sections 58 of the web of material 60 have been folded to form the stack 56, the carriage 12 is transferred into the right-hand end position 12', shown in FIG. 8. In this position, the carriage 12 is stopped and the clamping member 43 is transferred into the rest position 43' (compare FIG. 2). Then the belt 32 is driven in a circulating manner in conveying direction F by means of the conveying drive 86 until the last-formed finished stack 56 has passed the light barrier 80. The position of this stack corresponds to the stack denoted in FIG. 8 by 56*b*. The conveying drive 86 is then switched off again and the clamping member 43 is transferred into the clamping position, in order to clamp the belt 32 again between itself and the rack 10. For the formation of a new stack, the pressing element 66 is lowered and the motor 76 is set in operation again.

It is also conceivable that only a single clamping arrangement 44 or 46 is provided. Then, however, only the stroke of the carriage 12 from the left-hand end position to the right-hand end position 12' or from the right-hand end position 12' to the left-hand end position 12 can be utilized for the transporting away of the finished stacks 56, 56*a* . . . . For the respective stroke in the opposite direction, the corresponding clamping arrangement 44, 46 would then have to be released and the clamping device 43 activated.

It is, of course, also conceivable for a clamping device to be provided which acts on a roll 38, 40 or the second deflection roller 28. In this case, the belt 32 would have to be connected in a non-slipping manner to the corresponding roll 38 or 40 or to the deflection roller 28. It is also conceivable for a clamping arrangement to be provided which acts on the deflection roll 18 or on the deflection roller 22. In this case, again the belt 32 would have to be connected in a non-slipping manner to this deflection roll 18 or deflection roller 22. In an embodiment of the apparatus similar to that shown in FIG. 8, the clamping member denoted by reference numeral 43 is not necessary if the conveying drive 86 is such that it is able to hold the endless belt 32 motionless during the folding operation of the web of material 60. Accordingly, conveying drive 86 comprises breaking means or a breakable conveying motor 88.

I claim:

1. In a stack-forming apparatus for producing finished stacks of zigzag folded sections from a continuous web of material fed from below, said apparatus comprising a rack having a reciprocatingly translatably driven carriage; two deflection members on said carriage forming a web feeding gap oriented essentially perpendicularly to the reciprocal motion of the carriage and translatable therewith between two end positions separated at least by the length of a web section; first and second support elements in the form of belts which have stack-supporting upper sides, which pass around the deflection members, and which have lower sections; length compensating arrangements that compensate for changes in the length of the support elements' upper sides due to translation of the carriage; holding elements that fix said support elements relative to the rack during stack formation; and carriage drive means for reciprocatingly translating the carriage, the improvement comprising:

a. said first support element being of endless design;

b. for said first support element, a deflection arrangement mounted on said rack and defining an end of said element's stack supporting side remote from said deflection members, c. the holding element for said first support element being operable from an hold position to a rest position;

d. selectively engageable first support element drive means for conveying away finished stacks, and e. a first support element control including means for switching the holding element to its hold position during stack formation and to its rest position for conveying away finished stacks and including means for disengaging the first support element drive means for stack formation and engaging it for conveying away finished stacks.

2. Apparatus according to claim 1 further comprising:

f. clamp means operable from a clamp position connecting the first support element to the carriage to a rest position, wherein said first support element drive means includes said carriage drive means, and wherein said control additionally includes means for switching said clamp means to its rest position for stack formation and to its clamp position for conveying away finished stacks.

3. Apparatus according to claim 2 wherein the holding element for said first support element is located in the region of said deflection arrangement and, in its hold position, bears on said first support element.

4. Apparatus according to claim 3 wherein the deflection arrangement comprises an upper rack-supported deflection roll and a lower rack-supported deflection roll, wherein said holding element is located between said rolls, and wherein in its hold position said holding element presses said first support element against the rack.

5. Apparatus according to claim 2 wherein said clamp means comprises first and second clamping arrangements, each operable from a clamp position to a rest position, said first clamping arrangement in its clamp position causing the stack supporting upper side of said first support element to translate with the carriage and said second clamping arrangement in its clamp position causing the stack supporting upper side of said first support element to translate oppositely to the carriage, and wherein said control additionally includes means for alternately switching one of said first and second clamping arrangements to its clamp position for conveying away finished stacks.

6. Apparatus according to claim 5 wherein said second clamping arrangement comprises a movable clamping element and a stop member, both supported by the carriage, and in its clamp position engages that portion of said first support element lying between the second deflection roller and the deflection arrangement.

7. Apparatus according to claim 2 wherein said clamp means comprises a single clamp, and wherein said control additionally includes means for switching said holding element to its hold position and said clamp means to its rest position and for switching said holding element to its rest position and said clamp means to its clamp position for conveying away finished stacks.

8. Apparatus according to claim 1 wherein the length compensating arrangement for said first support element comprises a first deflection roller supported by the carriage and a second deflection roller supported by the rack, wherein the first support element passes in the form of an S over its associated deflection member, said first deflection roller and said second deflection roller.

9. Apparatus according to claim 8 further comprising:

f. clamp means operable from a clamp position connecting the first support element to the carriage to a rest position, wherein said first support element drive means includes said carriage drive means, and wherein said control additionally includes means for switching said clamp means to its rest position for stack formation and to its clamp position for conveying away finished stacks.

10. Apparatus according to claim 9 wherein the holding element for said first support element is located in the region of said deflection arrangement and, in its hold position, bears on said first support element.

11. Apparatus according to claim 10 wherein the deflection arrangement comprises an upper rack-supported deflection roll and a lower rack-supported deflection roll, wherein said holding element is located between said rolls, and wherein in its hold position said holding element presses said first support element against the rack.

12. Apparatus according to claim 9 wherein said clamp means comprises first and second clamping arrangements, each operable from a clamp position to a rest position, said first clamping arrangement in its clamp position causing the stack supporting upper side of said first support element to translate with the carriage and said second clamping arrangement in its clamp position causing the stack supporting upper side of said first support element to translate oppositely to the carriage, and wherein said control additionally includes means for alternately switching one of said first and second clamping arrangements to its clamp position for conveying away finished stacks.

13. Apparatus according to claim 12 wherein said first clamping arrangement is supported by the carriage and in its clamp position presses said first support element against the first deflection roller.

14. Apparatus according to claim 13 wherein said second clamping arrangement comprises a movable clamping element and a stop member, both supported by the carriage, and in its clamp position engages that portion of said first support element lying between the second deflection roller and the deflection arrangement.

15. Apparatus according to claim 14 wherein the deflection arrangement comprises an upper rack-supported deflection roll and a lower rack-supported deflection roll, wherein said holding element is located between said rolls, and wherein in its hold position said holding element presses said first support element against said rack.

16. Apparatus according to claim 12 further comprising a light barrier, connected to said control means, for detecting when a finished stack has been conveyed away a preselected distance, said distance being a multiple of the length of a folded section.

17. Apparatus according to claim 12 additionally comprising a pressing element located above the rack in the area of stack formation, said pressing element being vertically displaceable from a lowered, pressing position proximate said carriage to a rest position remote from the carriage, wherein said control includes means for switching said pressing element to its pressing position during the initial portion of stack formation.

18. Apparatus according to claim 1 wherein the deflection arrangement comprises an upper rack-supported deflection roll and a lower rack-supported deflection roll, and wherein said first support element drive means comprises a conveying motor drivingly engageable to one of said upper and lower rack-supported deflection rolls.

19. Apparatus according to claim 18 wherein the length compensating arrangement for said first support element comprises a first deflection roller supported by said carriage and a second deflection roller supported by said rack, wherein the first support element passes in the form of an S over its associated deflection member, said first deflection roller and said second deflection roller.

20. Apparatus according to claim 19 wherein the holding element for the first support element is located between said upper and lower deflection rolls, and wherein in its hold position said holding element presses said first support element against the rack.

21. Apparatus according to claim 18 wherein said first support element drive means includes the holding element for the first support element.

22. Apparatus according to claim 1 additionally comprising a pressing element located above the rack in the area of stack formation, said pressing element being vertically displaceable from a lowered, pressing position proximate said carriage to a rest position remote from the carriage, wherein said control includes means for switching said pressing element to its pressing position during the initial portion of stack formation.

23. A stack-forming and conveying process for successively forming and conveying away one finished stack of a multiplicity of joined stacks using the apparatus of claim 10 comprising the steps of:

(A) forming the finished stack by
  (1) switching the holding element to its hold position,
  (2) switching the clamp means to its rest position,
  (3) providing the continuous web to the wed feeding gap from below, and
  (4) reciprocatingly driving said carriage to form said finished stack; then (B) conveying away the finished stack by
  (5) switching the holding element to its rest position,
  (6) reciprocatingly driving said carriage, and
  (7) alternately switching one of said first and second clamping arrangements to its clamp position and the other of said clamping arrangements to its rest position in coordination with reciprocation of the carriage so that said finished stack is conveyed away during a multiplicity of successive carriage strokes; and then (C) resetting the apparatus for stack formation by
  (8) switching the holding element to its hold position, and
  (9) switching the clamp means to its rest position.

* * * * *